US005373122A

United States Patent [19]

Henry

[11] Patent Number: 5,373,122

[45] Date of Patent: Dec. 13, 1994

[54] DUAL ACTUATOR MECHANICAL SWITCH

[75] Inventor: Dennis P. Henry, Holland, N.Y.

[73] Assignee: Inventio AG, Hergiswil NW, Switzerland

[21] Appl. No.: 135,796

[22] Filed: Oct. 13, 1993

[51] Int. Cl.[5] ..... B66B 3/02; H01H 3/42

[52] U.S. Cl. ..... 187/394; 200/574; 200/61.42

[58] Field of Search ..... 187/102, 103, 104, 105, 187/113, 117, 129, 134, 34, 35, 32, 77, 100; 200/134, 574, 573 F, 61.42 G

[56] References Cited

U.S. PATENT DOCUMENTS

| | | | |
|---|---|---|---|
| 3,165,600 | 1/1965 | Chasar et al. | 200/47 |
| 3,955,649 | 5/1976 | Takenoshita et al. | 187/110 |
| 4,431,358 | 2/1984 | Jenkner | 414/114 |
| 4,971,178 | 11/1990 | Schauder et al. | 187/117 |

FOREIGN PATENT DOCUMENTS

| | | | |
|---|---|---|---|
| 318111 | 2/1944 | Germany . | |
| 4-365765 | 12/1992 | Japan | 187/105 |

*Primary Examiner*—Steven L. Stephan
*Assistant Examiner*—Robert Nappi
*Attorney, Agent, or Firm*—Howard & Howard

[57] ABSTRACT

A floor switch mounted on an elevator shaft wall has a housing from which a shaft extends. An arm has one end attached to the shaft and an opposite end attached to a roller. The roller is engaged by a switching vane mounted on an elevator car during up and down travel of the car in the shaft. As the car passes the switch, the vane rotates the arm and the shaft to move a lever which is coupled to actuate switch contacts in the housing. To avoid the engagement of the roller by the vane, a magnetic switch is mounted in the housing and is responsive to a magnet mounted on the car. The magnet mounted on the car passes the magnetic switch shortly before the vane is to engage the roller and the magnetic switch connects a coil in the housing to electrical power. The coil retracts an armature which is coupled to the lever to move the roller out of the path of travel of the vane.

13 Claims, 1 Drawing Sheet

DUAL ACTUATOR MECHANICAL SWITCH

BACKGROUND OF THE INVENTION

The present invention relates generally to a mechanically actuated switch and, in particular, to an elevator shaft mounted switch actuated by a passing elevator car.

The German patent document DE 747 641 shows a floor switch mounted at each floor in an elevator shaft which switches control a function in the elevator car such as enabling the car doors to be opened when the elevator car enters a levelling zone at a floor. A switching vane mounted on the elevator car actuates the floor switch during passage of the elevator car. The floor switch includes a lever pivoted on the floor switch having a roller which is engaged by the switching vane. As the lever is moved by the switching vane from one position to another, a stud on the lever shifts a contact lever from a first contact onto a second contact thereby actuating the floor switch.

A disadvantage of this device is that every floor switch is actuated by the switching vane each time that the elevator car passes. The engagement of the switching vane with the floor switch roller produces unpleasant noises in the elevator car.

SUMMARY OF THE INVENTION

The present invention concerns a floor switch for operation by a passing elevator car. The floor switch is mounted on the wall of an elevator shaft and includes a first mechanical actuator means for the actuation of an electrical contact by engagement with a switching vane on the elevator car and a second actuator means operated non-mechanically by a first portion mounted on the floor switch and a second portion mounted on the elevator car whereby switching vane does not engage the first actuator means. The floor switch includes a housing for mounting on a wall in an elevator shaft; switch contacts mounted in the housing; a lever positioned in the housing and having one end coupled to the switch contacts and another end; a shaft rotatably mounted in the housing and having one end being coupled to the another end of the lever, the shaft having another end extending from the housing into the elevator shaft; an arm having one end attached to the another end of the shaft and another end with a roller attached thereto, the roller being engaged by a switching vane mounted on an elevator car travelling in the elevator shaft as the elevator car passes the housing to rotate the shaft and mechanically actuate the switch contacts; a coil and armature positioned in the housing, the armature being coupled to the lever; and a magnetic switch mounted on the housing and electrically connected to the coil, the magnetic switch being responsive to a magnet mounted on the elevator car for activating the coil to move the lever to actuate the switch contacts and for rotating the shaft to move the roller out of a path of travel of the switching vane to prevent engagement of the roller by the switching vane.

The present invention solves the problems of and avoids the drawbacks of the known floor switch by providing a dual actuator floor switch which satisfies the requirements of the elevator safety code while adding to the travelling comfort of the elevator passenger during traverse of the entire height of the elevator shaft.

The advantage achieved by the present invention is that a noiseless travel is possible and that the switches arranged on each floor can be passed more rapidly.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
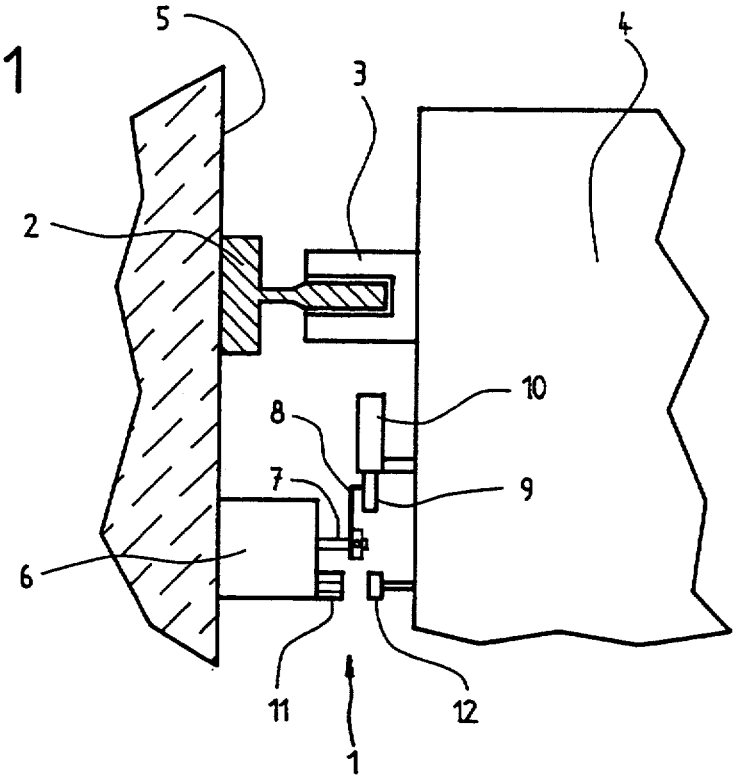
FIG. 1 is an horizontal cross-sectional view of an elevator shaft with an elevator car movable therein and a floor switch apparatus in accordance with the present invention.

There is shown in the FIG. 1, a cross-sectional, partial top plan view of an elevator shaft 1 having a side wall 5 to which is attached a vertically extending guide rail 2. A generally U-shaped guide shoe 3 is affixed to an elevator car 4 which travels in the elevator shaft with the guide shoe 3 engaging the guide rail 2. Spaced horizontally from the guide rail 2 is a floor switch 6 attached to the shaft wall 5. Extending from the switch 6, generally perpendicular to the surface of the wall 5, is a rotatable shaft 7 to which one end of an arm 8 is attached. The arm 8 extends generally parallel to the wall 5 and has a free end to which a roller 9 is attached. The roller 9 is engaged by a switching vane 10 attached to a side wall of the elevator car 4 facing the side wall 5 of the elevator shaft 1. During the travel of the elevator car 4 in the elevator shaft 1, the switching vane 10 passes the switch 6 and engages the roller 9 to rotate the arm 8 and the shaft 7. As explained below, the shaft 7, the arm 8 and the roller 9 form a first actuator for actuating the floor switch 6. Such floor switch actuation is typical of the known elevator systems in which a floor switch is provided for each direction of travel at each floor. Furthermore other uses are door zone, normal terminal stopping, emergency terminal stopping, emergency terminal speed limiting a circuits.

In accordance with the present invention, the engagement of the roller 9 by the switching vane 10 is avoided. To this end, a control means first portion, such as a magnetic switch 11, is attached to an exterior surface of the switch 6. Shortly prior to the switching vane 10 moving past of the roller 9, the control means first portion is responsive to the presence of a control means second portion mounted on the car to enable a second actuator to rotate the shaft 7 and move the arm 8 with the roller 9 out of the path of travel of the switching vane 10 as explained below. The control means second portion can be a magnet 12 attached to the side wall of the elevator car 4 in a position to activate the magnetic switch 11 shortly before the point at which the switching vane 10 would engage the roller 9.

Figure 2:
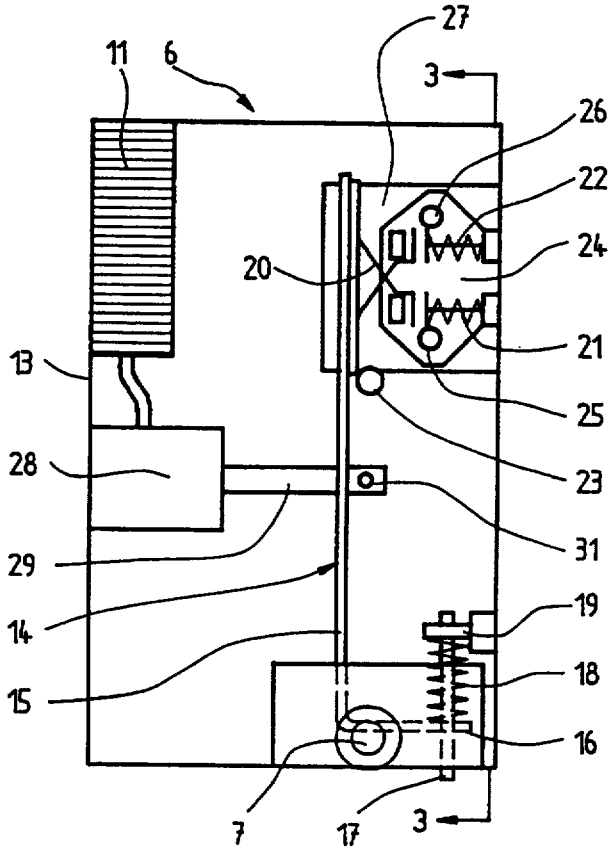
FIG. 2 is an enlarged front elevation view of the floor switch apparatus shown in the FIG. 1 with a front wall of the switch housing removed.
Figure 3:
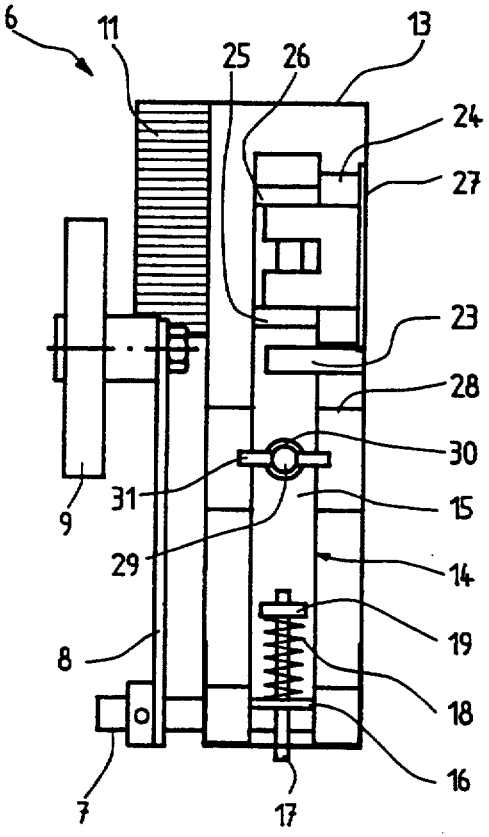
FIG. 3 is an enlarged cross-sectional view of the floor switch apparatus shown in the FIG. 1 as if taken along the line 3—3 in the FIG. 2.

As shown in the FIGS. 2 and 3, the floor switch 6 includes a housing 13 with, a control device, the magnetic switch 11, mounted on an exterior surface of the housing 13. The switch 6 also includes an L-shaped lever 14 having a longer, generally vertically extending lever arm 15 and a shorter, generally horizontally extending lever arm 16. The lever 14 is located in the housing 13 and the shorter lever arm 16 is coupled or attached to the shaft 7 in any suitable manner near a junction of the longer and shorter lever arms. A bolt 17 inside the housing 13 extends generally vertically through a bore of a generally helical spring 18, through an aperture in the shorter lever arm 16 and through an aperture in a bottom wall of the housing 13. A holder or bracket 19 is attached to an interior surface of the housing 13 and retains an upper end of the bolt 17. The spring 18 is designed as a compression spring with one end abutting the holder 19 and an opposite end abutting a free end of the shorter lever arm 16. Thus, the spring 18 biases the free end of the shorter lever arm 16 downwardly.

Attached to a free end of the longer lever arm 15 is a contact bridge 20 (FIG. 2) which connects a first spring contact 21 (FIG. 2) with a second spring contact 22 (FIG. 2). A mechanical stop 23 attached to the interior surface of the housing 13 limits the deflection of the longer lever arm 15 toward the contacts 21 and 22 and also limits the freedom of movement of the contact bridge 20. Positioned beneath the spring contacts 21 and 22 is an insulating socket 24 upon which is mounted a first connecting terminal 25 (FIG. 2), connected with the first spring contact 21, and a second connecting terminal 26 (FIG. 2), connected with the second spring contact 22. Positioned beneath the insulating socket 24 is a mounting plate 27 which extends beyond the contact bridge 20. The mounting plate 27 is attached to the interior surface of the housing 13 and the insulating socket 24 is mounted thereon. The spring 18 biases the longer lever arm 15 and the contact bridge 20 to maintain the contacts 21 and 22 normally closed.

Attached to the interior surface of the housing 13 is a coil 28 located on the opposite side of the longer lever arm 15 from the contact bridge 20. The coil 28 is electrically connected to a power supply (not shown) through the magnetic switch 11 which is normally open. A bolt shaped armature 29 extends from the coil 28 and passes through an opening 30 (FIG. 3) formed in a central portion of the longer lever arm 15. A split or roll pin 31 extends through a free end of the armature 29. Upon activation of the coil 28 by closing the magnetic switch 11 to apply electrical power, the bolt shaped armature 29 is pulled into the coil 28 with the pin 31 engaging the longer lever arm 15 and pulling it along. Thus, the shaft 7 and the arm 8 are rotated (counterclockwise in the FIG. 2) to move the roller 9 out of the path of travel of the switching vane 10. Also, the movement of the lever 14 opens the contacts 21 and 22 thereby actuating the floor switch 6. The opening 30, the bolt shaped armature 29 and pin 31 cooperate such that, on failure of the magnetic switch 11 or the coil 28, the lever 14 remains movable so that the switch 6 can actuated by the engagement of the roller 9 by the switching vane 10.

The magnetic switch 11 can be of any suitable type. For example, a magnetic switch which is actuated in the presence of the magnet 12 and thereafter resumes a normally open original switching state. Or a magnetic switch which is actuated in the presence of the magnet 12 and retains a closed switching state until it is switched back to the normally open original switching switch by a following magnet on the elevator car. Furthermore, other types of switching means can be used instead of the magnetic switch 11. For example, opto-electronic switches having light emitters and light receivers can be actuated by a reflector mounted on the elevator car 4 in place of the magnet 12. The opto-electronic switch can assume an astable or a bistable switching state as explained above with respect to the magnetic switches. The coil 28 also can be controlled by signals from the mechanical switches with vanes on the elevator car, by means of capacitative switches, by means of signals from the elevator control or by means of signals from computers.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A floor switch for mounting on a wall of an elevator shaft for actuation by a passing elevator car comprising:

floor switch contacts for mounting on a wall in an elevator shaft;

a first actuator connected to said switch contacts and extending into the elevator shaft, said first actuator being engaged by a switching vane mounted on an elevator car travelling in the elevator shaft as the elevator car passes said first actuator to mechanically actuate said switch contacts;

a second actuator coupled to said first actuator and to said switch contacts for actuating said switch contacts and for moving said first actuator out of a path of travel of the switching vane to prevent engagement of said first actuator by the switching vane; and control means connected to said second actuator for selectively operating said second actuator in response to the elevator car approaching said first actuator whereby failure of said second actuator permits actuation of said first actuator by the switching vane on the elevator car.

2. The floor switch according to claim 1 wherein said first actuator includes a rotatable shaft connected to said floor switch contacts, a roller for engaging the switching vane and an arm connected between said shaft and said roller, said shaft being rotated by engagement of said roller with the switching vane to actuate said floor switch contacts.

3. The floor switch according to claim 2 including a lever connected between said floor switch contacts and said shaft and wherein said second actuator is coupled to said lever.

4. The floor switch according to claim 3 including a spring abutting said lever for biasing said floor switch contacts closed.

5. The floor switch according to claim 1 wherein said control means includes a first portion connected to said second actuator and a second portion for mounting on the elevator car, said first portion being responsive to a presence of said second portion for activating said second actuator to actuate said floor switch contacts and move said first actuator.

6. The floor switch according to claim 1 wherein said second actuator includes an electrical coil and said control means connects said coil to a source of electrical power to actuate said floor switch contacts and move said first actuator.

7. The floor switch according to claim 6 wherein said control means includes a magnetic switch and a magnet, said magnetic switch being responsive to a presence of said magnet mounted on the elevator car for connecting said coil to a source of electric power.

8. The floor switch according to claim 6 including a lever connected between said floor switch contacts and said first actuator and wherein said coil includes a bolt shaped armature having a free end which extends through an opening formed in said lever and a pin extending through said free end of said armature for engaging said lever when electrical power is connected to said coil to retract said armature.

9. A floor switch for mounting on a wall of an elevator shaft for actuation by a passing elevator car comprising:

a housing for mounting on a wall in an elevator shaft;

switch contacts mounted in said housing;

a lever positioned in said housing, said lever having a longer arm and a shorter arm, said longer arm having one end attached to said switch contacts;

a shaft rotatably mounted in said housing and having one end being coupled to said shorter arm of said lever, said shaft having another end extending from said housing into the elevator shaft;

an arm having one end attached to said another end of said shaft and another end with a roller attached thereto, said roller being engaged by a switching vane mounted on an elevator car travelling in the elevator shaft as the elevator car passes said housing to rotate said shaft and mechanically actuate said switch contacts;

a coil and armature positioned in said housing, said armature being coupled to said lever; and a control means first portion mounted on said housing and connected to said coil, said control means first portion being responsive to a control means second portion mounted on the elevator car for activating said coil to move said lever to actuate said switch contacts and for rotating said shaft to move said roller out of a path of travel of the switching vane to prevent engagement of said roller by the switching vane.

10. The floor switch according to claim 9 wherein said control means first portion is a magnetic switch and said control means second portion is a magnet, said magnetic switch being responsive to a presence of said magnet mounted on the elevator car for connecting said coil to a source of electric power.

11. The floor switch according to claim 9 wherein said coil includes a bolt shaped armature having a free end which extends through an opening formed in said lever and a pin extending through said free end of said armature for engaging said lever when electrical power is connected to said coil to retract said armature.

12. A floor switch for mounting on a wall of an elevator shaft for actuation by a passing elevator car comprising:

a housing for mounting on a wall in an elevator shaft;

switch contacts mounted in said housing;

a lever positioned in said housing and having one end connected to said switch contacts and another end;

a first actuator connected to said lever and extending from said housing into the elevator shaft for engagement by a switching vane mounted on an elevator car travelling in the elevator shaft as the elevator car passes said housing to mechanically actuate said switch contacts;

a second actuator positioned in said housing and coupled to said lever; and control means connected to said second actuator, said control means having a first portion mounted on said housing and being responsive to a presence of a second portion mounted on the elevator car for activating said second actuator to move said lever and actuate said switch contacts and for moving said first actuator out of a path of travel of the switching vane to prevent engagement of said first actuator by the switching vane.

13. The floor switch according to claim 12 wherein said second actuator includes a coil and a bolt shaped armature having a free end which extends through an opening formed in said lever and a pin extending through said free end of said armature for engaging said lever when electrical power is connected to said coil to retract said armature.

* * * * *